United States Patent [19]

Fee et al.

[11] Patent Number: 4,918,900

[45] Date of Patent: Apr. 24, 1990

[54] LIGHT-WEIGHT WALL PANEL FOR PROTECTIVE ENCLOSURE

[75] Inventors: Kevin A. Fee, Marion; Mark S. Hollinrake, Hiawatha, both of Iowa

[73] Assignee: Inter Innovation LeFebure Manufacturing Corp., Cedar Rapids, Iowa

[21] Appl. No.: 374,303

[22] Filed: Jun. 30, 1989

[51] Int. Cl.[5] ..... E04C 2/00

[52] U.S. Cl. ..... 52/811; 52/813; 109/80; 109/82

[58] Field of Search ..... 52/811-813, 52/823; 109/49.5, 78, 80, 82, 84, 76, 64, 65, 24

[56] References Cited

U.S. PATENT DOCUMENTS 3,645,216 2/1972 Redford et al. .
4,389,948 6/1983 Sands et al. .
4,455,801 6/1984 Merritt .
4,559,881 12/1985 Lankard et al. .

OTHER PUBLICATIONS

Textbook of Wood Technology-Panshin and Zeeuw, ©1980, pp. 127 & 499.

*Primary Examiner*—Carl D. Friedman

*Assistant Examiner*—Linda J. Hoffert

*Attorney, Agent, or Firm*—Simmons, Perrine, Albright and Elwood

[57] ABSTRACT

A light-weight wall panel for a protective enclosure includes a shell of sheet metal which encases a filler structure of a combination of penetration resisting or hard wood and metal members. The filler structure includes first and second wall structures which differ from one another by the orientation of hard wood and sheets of expanded metal which are interleaved between adjacent ones of the boards. In the first wall structure adajcent one of the major surfaces of the wall panel, the hard wood boards and interleaved metal sheets have their major surfaces oriented perpendicular to the major surfaces of the wall panel. The second wall structure adjacent the other of the major surfaces of the wall panel has layers of hard wood boards and sheets of expanded sheet metal which extend with their major surfaces parallel to the major surfaces of the wall panel. The two wall structures are fastened to each other and hence into a single structure. The fasteners are elongate metal members, such as nails, which form in combination with the sheets of expanded metal a metal lattice to enhance the penetration resistance of the wall panel.

11 Claims, 1 Drawing Sheet

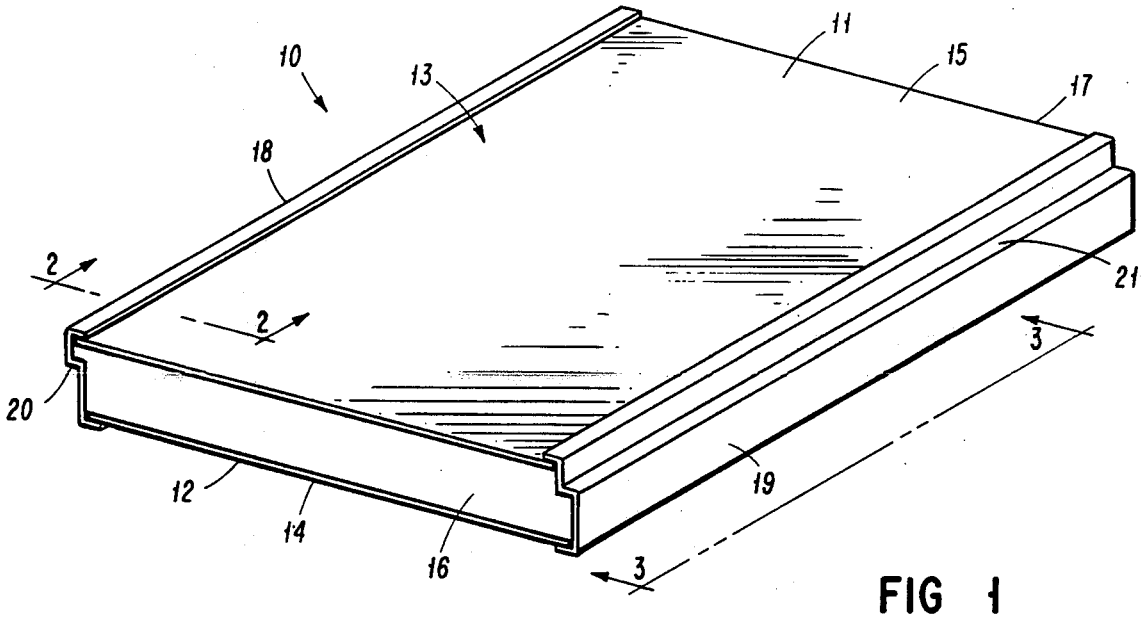
FIG 1
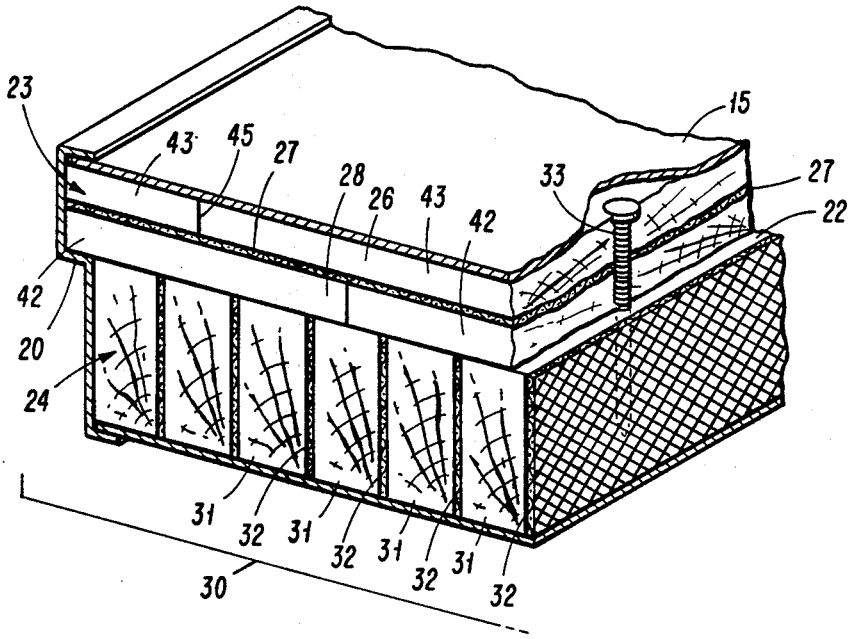
FIG 2
FIG 4
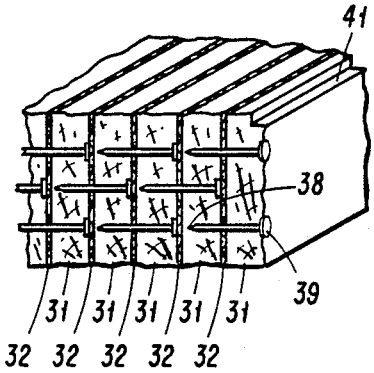
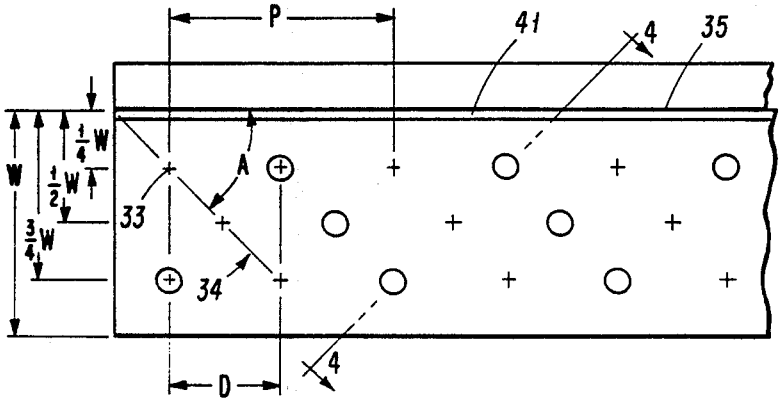
FIG 3

LIGHT-WEIGHT WALL PANEL FOR PROTECTIVE ENCLOSURE

BACKGROUND OF THE INVENTION

1. Field of the Invention

The invention relates generally to safes and bank protection and more particularly to wall and panel structures as may be used in modular vault structures.

2. Description of Related Art

Vault structures are classified according to their resistance to penetration attempts. Such resistance is measured in terms of the length of time required for a skilled person to gain access through the walls of a vault with the help of common mechanical tools, electric tools, cutting torches, or combinations thereof. Walls of a type referred to as Class 1 need to resist such attack for a period of one-half of an hour. Classes 2 and 3 pertain to vault structures having greater resistance to forced entry attempts. Vault structures classified in Classes 2 and 3 are those that have been tested and found to resist sustained attempts for one and two hours, respectively.

Though vaults with a greater penetration resistance would appear to be more desirable, in many instances the greater resistance to forced entries and the resulting delays greater than one-half hour are not needed because of other existing security precautions. In most secured areas, secure enclosures are protected by a combination of protective devices and arrangements, including security guard services in addition to electronic alarm systems. A reasonable resistance to any forced entry attempt would consequently allow effective countermeasures to be implemented within the period of delay offered by the wall of the secured enclosure.

In many instances light-weight wall panel structures for secured enclosures such as vaults may be preferred, particularly, when the vaults are to be built in upper stories of multi-story buildings. For such applications of light-weight wall panels for secured enclosures, an optimization of resistance within necessary weight limitations and also with reasonable budgetary constraints is desirable.

Currently existing light-weight wall panels for vaults are typically laminar structures including layers of hardwood planks interleaved with layers of expanded metal and pressboard or the like, all of which are joined, typically such as by nailing. A possible problem with existing prior art wall structures is that uniformly repeated structures tend to enhance the likelihood of success in attempts of forced entry, in that a successful intrusion through a first layer is likely to be repeated in less time with respect to a similar, second layer.

SUMMARY OF THE INVENTION

The present invention seeks to overcome deficiencies in prior wall panel structures with an improved light-weight wall panel for protective enclosures.

According to one aspect of the invention, a light-weight wall panel structure includes an inner layered structure and an outer compound structure. The structures are disposed adjacent one another in parallel to a major plane of the panel, both of such structures being encased by a common shell of sheet material. The inner structure includes layers of penetration resisting or hard wood disposed in the major plane of the wall panel structure, such hardwood layers being interleaved with expanded metal. The outer structure is formed of a plurality of longitudinally adjacent hard wood boards of rectangular cross section, the length of a major side of the rectangular cross section extending perpendicular to the major plane of the wall panel structure. Each two adjacent ones of the boards are separated by an interleaved expanded metal sheet. Adjacent ones of such hard wood boards are joined to each other by fasteners.

According to another aspect of the invention, the fasteners are elongate metal members which are inserted in a staggered, offset pattern in a direction substantially perpendicular to the metal sheets which are interleaved between the hard wood boards. The metal members and the interleaved metal sheets form in combination a metal matrix throughout the volume of the hard wood boards of the outer structure. The matrix and correspondingly alternate hard wood boards in the outer structure extend in a direction orthogonal to the direction of corresponding members of the inner wall structure.

The various features and advantages of the invention will be best understood by the following detailed description of a preferred embodiment of the invention, when read in reference to the appended drawings.

BRIEF DESCRIPTION OF THE DRAWINGS

FIG. 1 is a pictorial view of a light-weight wall panel as a preferred embodiment of the invention;

FIG. 2 shows in section a portion of the wall panel shown in FIG. 1, the section taken along "2—2" in FIG. 1;

FIG. 3 is a schematic view into a side face of the wall panel of FIG. 1, the view taken in a direction indicated by the arrows "3—3" shown in FIG. 1 and depicting further details of the panel structure; and FIG. 4 is a section through structural members of the wall panel, taken in a direction through a plane of fasteners, as indicated by Section "4—4" in FIG. 3.

DETAILED DESCRIPTION OF THE INVENTION

Referring to FIG. 1, there is shown a light-weight wall panel which is designated generally by the numeral 10. In accordance with current vault construction practices, wall panels, of a general shape as the panel 10, are joined along typically rabbet tape edges to form vertical walls as well as top and bottom boundaries of vaults. The panel 10 has oppositely facing inner and outer major wall surfaces 11 and 12, respectively. The term "inner" of the wall surface 11 refers to a preferred position and orientation of the wall surface in reference to a potential use of the panel 10 in the wall of a protected enclosure or vault. The inner major wall surface 11 would, consequently, be located on the inside of the vault when the wall panel 10 is incorporated into a wall of such vault. Correspondingly, the outer major wall surface 12 would become part of the outer wall of such a vault.

A shell 13 of steel covers all surfaces of the wall panel 10, thus covering the major surfaces 11 and 12 as well as all edges of the panel 10. The shell 13 is comprised of an outer surface sheet 14, an inner surface sheet 15, planar end caps 16 and 17, respectively, and rabbet type longitudinal edge caps 18 and 19. The surface sheets 14 and 15, and the caps 16, 17, 18 and 19 are preferred to a steel sheet of an 18 Gauge steel material. The caps 16, 17, 18 and 19 are, in the course of assembling the wall panel 10, welded at their edges with correspondingly adjacent ones of the sheets or caps to join the individual sheets and caps into the unitized shell 13 as shown in FIG. 1.

Referring to FIG. 1 and FIG. 2, the rabbet type caps 18 and 19 preferably have their respective offsets 20 and 21 adjacent a plane 22. The offset 20 may be positioned closer to the inner surface sheet 15 than the offset 21 to avoid interferences when the panel 10 is assembled into a wall of a vault. The plane 22 is the interface in which an inward disposed portion of the wall panel 10, referred to as inner wall structure 23, joins an outward facing portion of the wall panel 10, correspondingly referred to as outer wall structure 24. Again, the terms "inward" and "outward" are in reference to an ultimate location of the wall panel 10 in the wall of a vault.

In balancing weight limitations against strength considerations, the orientation of layers of selected materials in the respective inner and outer wall structures 23 and 24, as hereinafter described, are believed to advantageously increase in their combination the penetration resistance of the wall panel 10. The increase in penetration resistance, in turn, offers a wider range of materials which are suitable for use in the structures 23 and 24 without degradation of the penetration resistance of the wall panel 10 to an undersirable level. Of various type of woods available for wood structures, certain hardwoods, for example oak or hickory woods are dense, hence heavy in weight, but also of a good penetration resistance. These types of hardwood are preferred for the inner wall structure 23. There are other types of wood which are lighter in weight than oak, but which also are considered to possess some characteristics similar to those of hardwoods to provide as used within the structure described herein a penetration resistance of a desirable level. Such penetration resisting or hard include, for example, fir or hemlock. The latter woods may be used, for example, in the outer wall structure 24. In the selection of woods for the panel 10 a solid, hard wood, hence a material of good quality, should be preferred over material which shows voids or other weaknesses, regardless of the type of wood. The selection of quality hard woods hence, should be universal while the selection of the type of wood may at times be based on availability.

In reference to FIG. 2, the inner wall structure 23 is, in the described preferred embodiment of the invention, comprised of two layers of hard wood boards, for example oak, which are reinforced by an interleaving layer of expanded steel sheet. A first layer 26 of hard wood boards is in the described embodiment disposed immediately adjacent the inner surface sheet of the shell 13. Disposed adjacent the first layer 26 and toward the plane 22 is an intermediate sheet 27 of 16 Gauge flattened expanded metal, followed by a second layer 28 of hard wood boards, which are in the described embodiment also of oak. The second layer 28 occupies the remaining space of the inner wall structure 23 adjacent the plane 22 in which the inner wall structure 23 interfaces with the outer wall structure 24. The sheet 27 is interleaved between the first and second layers 26 and 28 to increase the penetration resistance of the structure.

Referring again to FIG. 2, the outer wall structure 24 differs from the described layered inner wall structure 23, in that alternately interleaved layers of hard wood and expanded metal do not extend in parallel to the major plane of the panel 10, but are oriented in planes perpendicular to the major plane of the panel 10. Thus, the outer wall structure 24 is formed of a stack 30 of alternately interleaved hard wood boards 31 and sheets 32 of expanded metal and, in contrast to the layered structure 23, the stack 30 itself extends in parallel to the major plane of the wall panel 10. Fir or hemlock is considered suitable for use as material of the hard wood boards 31. Within the stack 30, the major surfaces of the sheets 32 and the boards 31 lie in parallel planes to each other but perpendicular to the interface plane 22.

The manufacture of the wall panel 10, particularly of the outer wall structure 24 proceeds by alternately stacking one of the boards 31, one of the sheets 32 and a second one of the boards 31 in the manner shown in FIG. 2. Such first two boards 31 and the respective sheet 32 are fastened to each other before the next one of the interleaving sheets 32 of expanded metal and the next board 31 becomes added to the stack 30.

The boards can of course be fastened to each other in many different ways as well as by different means. The object is to join the boards to form the desired structure and simultaneously strengthen the structure to increase its penetration resistance. Thus, a preferred manner of fastening the boards 31 to each other to build the stack 30 is with elongate metal members inserted through at least two adjacent ones of the boards 31. A currently preferred manner for fastening the boards 31 to each other, and to thereby incorporate them into the stack 30, is by nailing. The nails are applied in a pattern which is best explained in reference to FIG. 3. FIG. 3 is a simplified view of the end face of the stack 30, showing an uppermost one of the boards 31. The direction of viewing such uppermost one of the boards 31 is indicated by the direction arrows "3—3" as shown in FIG. 1, except that for purposes of illustration, the rabbet type cap 19 is removed, hence not shown in FIG. 3. The boards 31 have in the preferred embodiment a cross section of nominally 2 inch by 4 inch. Fastening occurs preferably by nailing the boards with ring nails 33, which have a preferred length of four inches. A nailing pattern 34 for applying the nails 33 is shown in FIG. 3, a first pass of the pattern 34 being depicted by (+) symbols. Thus, the first pass of the pattern 34 is used for nailing the first and second of the boards 31 and the first sheet 32 into an integrated unit. The nails 33 are applied in a stagger-type pattern, with a preferred angle "A" with respect to a longitudinal edge 35, hence the length, of the board 31 of approximately forty degrees. The first nail is applied at one-forth of the width "W" of the board 31 at approximately one-forth of the width "W" from the end of the board 31. The next nail 33 is then nailed into the first two boards 31 in a position ideally in the center of the board 31, hence at one-half of its width as measured from the longitudinal edge 35 of the board 31 and at said preferred angle "A" of 40 degrees which the first two nails 33 form with respect to the longitudinal extent of the edge 35.

The 40 degrees for the angle "A" are of course merely a preferred choice. A reason for changing the angle would be to increase or decrease the density of the nails within the wood. The currently preferred nailing density is believed to provide the correct penetration resistance for a Class 1 type wall panel. Of course, such angle could be changed without departing from the spirit and scope of the invention. A typical range for the angle "A" of between 30 and 60 degrees is believed to be well within acceptable limits, and with possibly only minor changes in the penetration resistance of the panel 10. Changes in the penetration resistance are considered minor if they do not change noticeably the results of standard penetration tests. The third nail 33 is applied at about three-fourth of the width of the board 31 and substantially in line with the already applied nails 33.

The pattern 34 is then repeated at a preferred nominal pitch "P" of four inches. Again, the pitch "P" can be changed and would be acceptable within a relatively wide range of values. For example, pitch values between 3 and 6 inches may be considered acceptable for the described embodiment. Inaccuracies in the pattern 34 will result in non-linearities in the pattern, which again may affect the penetration resistance of the panel, but only to some degree. What should be realized, however, is that as a general proposition, the density of the pattern will affect to some degree the weight of the panel 10 and its resistance to penetration attempts. Ultimate dimensions of the pattern 34 may be chosen by taking into consideration the toughness of the wood and tradeoffs between weight, costs and penetration resistance. Results of standard tests on panels 10 of chosen dimensions and pattern values are then correlated to the dimensions and pattern values to establish the preferred dimensions, and to thereby achieve repeatability and quality in the production of further ones of such wall panels 10.

It is also to be realized that for widths "W" other than the nominal 4 inch width of the board 31 in the described embodiment, the values of the one-fourth, one-half and three-fourths of the width as well as the preferred value of the pitch would be likely to change. In general, a spacing of the nails 33 in a range of one to two inches is preferred.

In applying a subsequent interleaving sheet 32 to the stack 30 and then fastening a subsequent board 31 to the already assembled boards of the stack 30, a second pass of the pattern 34 repeats essentially the first pattern, except that the nails 33 applied during such second pass are preferably offset from the first pass by a predetermined distance "D", as shown by the symbol (o) in FIG. 3. In a preferred embodiment, the offset is chosen to be one-half of the value for the chosen pitch "P", though that is not a requirement for the advantages described herein.

An advantage of the described nailing pattern 34 is best realized from a sectional view through the stack 30, taken along alternate passes of the pattern 34, as shown in FIG. 4. FIG. 4 shows each of the nails 33 extending through essentially two of the boards 31. Slightly shorter nails would extend through less than two thicknesses. Preferably, the length of the nails 33 is chosen, to be equal to twice the thickness of the board 31. Thus, when the nails 33 are nailed into an uppermost board of the stack 30, the tips or points 38 will become positioned just short of striking heads 39 of nails 33 from two passes of pattern of nails prior to the pattern of nails 33 which is currently being applied. A gap between two adjacent and coextensively placed nails will be equal to twice the thickness of the sheet 32.

Thus, as becomes apparent from FIG. 4, the interleaving steel sheets 32 and the pattern 34 of nails 33 applied in a dual path of an alternately applied offset distances "D" generate a matrix structure of steel the voids between the lattice of which are occupied by the hard wood of the boards 31. The outer wall structure 24, consequently, is a compound structure of hard wood permeated by a steel matrix formed by the sheets 32 and the nails 33 applied substantially perpendicular to the planes in which the sheets 32 extend. It has been found that the compound structure assumes in its resistance to penetration a character of a homogeneous material with a toughness greater than that of the hard wood which represents its main material. At the same time the weight of the panel 10 becomes significantly less than that of concrete of similar penetration resistance.

To obtain an ideally regular matrix of the nails 33 and the steel sheets 32 the pattern 34 would need to be repeated precisely and all nails 33 would need to penetrate the hard wood perfectly perpendicular to the layers of the stack 30. It should be realized, however, that such regularity may not at all necessary for achieving the desired penetration resistance range. Other factors, such as the precise grain structure of the hard wood and a slight variance of the toughness and hardness of the hard wood from board to board also may affect the penetration resistance to some degree. The advantage of the desired toughness or penetration resistance is believe to result from the hard wood holding the steel in place to reinforce the steel matrix, while the steel matrix, such as the nails 33 lodged in the wood of the boards 31 toughen the boards. The precise position of each nail 33 in the boards 31 would therefore not affect the benefit that each nail 33 imparts to the boards 31. For example, slight imperfections in the hard wood grain structure may make it desirable to deviate from a perfectly aligned nailing pattern. Such a deviation in placing a nail away from its centered position of the pattern would not render the nail 33 less effective in strengthening the outer wall structure 24. In either position, the nail 33 reinforces the wood structure by its presence, while the wood in turn supports the nail in its position within the formed steel matrix permeating the wood.

Further boards 31 with interleaving ones of the sheets 32 are added to the attack 30 in the same manner of assembly until the stack 30 has reached the desired dimension for the width of the wall panel 10. A final one of the boards 31 may need to be notched as shown by a notch 41 as shown in FIG. 4, for example, to accommodate a displacement of the offset 21 toward the outer surface sheet 14. Such displacement avoids a possible assembly interference with an offset 20 of an adjacent wall panel 10.

Once the stack 30, hence the compound outer wall structure 24, has been built in the described manner, the inner wall structure 23 is assembled to the stack 30 by placing boards 42 of the second layer 28 against a major surface of the assembled outer wall structure 24. The steel sheet 27 of expanded metal is then placed onto the second layer 28 and boards 43 are placed on top of the sheet 27 to build up the first layer 26. The boards 43 of the first layer 26 are staggered with respect to boards 42 of the second layer. Consequently, joints 45 between adjacent ones of the boards 42 or 43 are also staggered or laterally offset. It may also be chosen to orient the direction of the grain of the boards 43, hence the length of the boards, at right angles to that of the boards 42.

The assembly of the inner wall structure 23 is then completed by nailing the boards 43 and 42 and the interleaving sheet 27 to the supporting outer wall structure 24. A preferred thickness for the boards 42 and 43 is seven-eights of an inch. The built up layers are, therefore, preferably nailed, as were the boards 31, with ring nails 33 having a length of four inches. The addition of the inner layered wall structure 23 to the outer compound wall structure 24 further increases the complexity of the combined structure. Hence, the penetration resistance of the combined wall structure also improves with its complexity, in that attempts to penetrate through the wall need to adapt to the changed character of the structure.

With respect to the positioning or labeling the wall structure 23 as the inner wall structure and the wall structure 24 as the outer wall structure, it should be realized that such positioning of the structures adjacent their respectively inner and outer surfaces of the panel is considered to be one of choice and preference and hence is particular to a preferred embodiment of the invention. It is deemed within the scope of the invention to reverse the described placement of the wall structures 23 and 24 such that the wall structure 24 might face toward an interior surface of a vault when the wall panel 10 is assembled into the wall of such a vault. An advantage, similar to the advantage sought by the described embodiment, of delaying a forced penetration attempt could be realized in that with either positioning of the structures 23 and 24, the change in the orientation of the hard wood panels and interleaved metal sheets changes partially through the thickness of the panel 10.

In the completion of the assembly of the wall panel 10, the built up and assembled inner and outer wall structures 23 and 24 are now placed between the inner and outer surface sheets 15 and 14. The respective rabbet type and planar caps are then fitted to the edges of the panel 10 and are welded to the surface sheets.

It is to be understood that the foregoing detailed description of a preferred embodiment of the invention brings to mind various other changes and modifications which can be made without departing from the spirit and scope of the invention. As already pointed out, changes in the nailing pattern can be made as well as in the type of hard wood used to build up the stack 30 of the outer structure 24 or the inner structure 23. Other changes which come to mind include a change in the type of fasteners used in conjunction with the hard wood boards, or in the type of steel used in the interleaved layers or in the shell 13. For example, a stainless steel could be used for the shell 13 when the cost of the panel is not a consideration. Also, among other possible changes and modifications, the thicknesses or widths of the boards such as the boards 31 can be changed without departing from the spirit and scope of the invention. This invention is to be defined and limited only by the scope of the claims appended hereto.

What is claimed is:

1. A wall panel for a protective enclosure, the wall panel having oppositely facing major surfaces and a compound wall structure there between, which structure comprises:

an outer wall structure including a plurality of first boards, and a plurality of first metal sheets, said first boards being disposed adjacent one another and said first metal sheets being interleaved between each two adjacent ones of such first boards to from a stack, said stack extending parallel of said major surfaces of said wall panel such that the combined thicknesses of the first boards and interleaved first metal sheets establish the width of said wall panel, adjacent first boards and a respective one of said interleaved first metal sheets being joined to each other by first elongate metal members extending substantially perpendicular through such adjacent first boards and forming a matrix of metal with such interleaving first metal sheets, said matrix permeating said stack of said first boards, said elongate metal members of said matrix extending substantially in parallel to, and said first metal sheets extending in planes perpendicular to, major surfaces of said wall panel;

an inner wall structure disposed adjacent said outer wall structure, said inner wall structure including at least first and second adjacent layers of second boards, said layers being disposed in planes parallel to said major surfaces of said wall panel, and an interleaving second metal sheet disposed between adjacent ones of said at least first and second layers of second boards, said inner wall structure being joined to said outer wall structure by second elongate metal members extending perpendicular to said major surfaces of said wall panel through said layers of interleaved second metal sheet and second boards and into said first boards; and a metal shell encasing said inner and outer wall structures.

2. A wall panel according to claim 1, wherein said first and second boards are hard wood boards, and said second elongate metal members have a length to extend through such at least first and second layers of second hard wood boards and into said stack of said first hard wood boards to thereby secure said layers of second metal sheet and second hard wood boards to each other and to said inner wall structure to said outer wall structure.

3. A wall panel according to claim 2, wherein said stack of said first hard wood boards and interleaved first metal sheets has a base and a top, and wherein said first elongate metal members have a top end and an opposite insertion end and extend within said stack in a direction with the top end toward said top of said stack and with the insertion end toward said base of said stack, said first elongate metal members being of a length of at least two thicknesses of said first hard wood boards to extend substantially through at least two adjacent ones of said first hard wood boards and respective interleaved first metal sheets of said stack.

4. A wall panel according to claim 3, wherein a selected number of said first elongate metal members extend in a repetitive patten from an upper surface of each of respectively upper ones of said first hard wood boards to lower ones of said first hard wood boards to lower ones of said first hard wood boards within said stack, said pattern in each tow adjacent ones of said respectively upper first hard wood boards being laterally offset by a first nominal dimension in a direction of the longitudinal extent of said first hard wood boards, and wherein a pitch of repetition for said repetitive pattern is determined to equal approximately a multiple of the dimension of the offset, as determined by the ratio of the lengths of the first elongate metal members to the thickness of said first hard wood boards.

5. A wall panel according to claim 4, wherein the length of the first metal members is twice the thickness of said first boards and all but one of said first boards at the base of said stack are upper boards, and wherein the pitch of said pattern is twice the dimension by which said pattern is offset in mutually adjacent ones of said upper first hard wood boards.

6. A wall panel according to claim 5, wherein the first elongate metal members are first type ring nails and each repetition of said repetitive pattern comprises at least one of said first type ring nails.

7. A wall panel according to claim 6, wherein each repetition of said repetitive pattern comprises a plurality of said first type ring nails, said first type ring nails in each such repetition being substantially equally spaced across a width of said respective upper first hard wood board.

8. A wall panel according to claim 7, wherein said first type ring nails in each such repetition are substantially equally spaced along a straight line across the width of said first hard wood boards.

9. A wall panel according to claim 8, wherein said straight line extends across said width at an angle between thirty to sixty degrees with respect to the length of said upper first hard wood board.

10. A wall panel for a protective enclosure, which comprises:

a metal shell including inner and outer surface sheets and a plurality of metal edge caps spacedly connecting said inner and outer surface sheets, thereby defining a space between such inner and outer surface sheets; and a filler structure occupying said space between said inner and outer surface sheets, said filler structure including first and second wall structures, said first and second wall structures extending in planes parallel to said inner and outer surface sheets, said first wall structure being disposed contiguous to a first one of said inner and outer surface sheets and having a filler structure of first hard wood boards in a stack including a first type sheet of expanded metal interleaved between each two adjacent ones of said first hard wood boards, said stack extending parallel to said first one of said inner and outer surface sheets, and a plurality of first elongate metal members extending substantially perpendicular to said first hard wood boards and forming a metal matrix with said first type interleaved sheet between each two adjacent ones of said first hard wood boards, said second wall structure being interposed contiguous to the second of said inner and outer surface sheets, said second wall structure including at least two layers of second hard wood boards, said second hard wood boards extending in a plane parallel to said inner and outer surface sheets, a second type sheet of expanded metal interleaved between each two adjacent ones of said at least two layers of second hard wood boards and a plurality of second elongate metal members extending perpendicular to said inner and outer surface sheets through said layers of second hard wood boards and into said first hard wood boards to fasten said layers of second hard wood boards to each other and to said first hard wood boards.

11. A wall panel according to claim 10, wherein said stack of said first hard wood boards and interleaved first type metal sheets has a base and a top and said first elongate metal members have a top end and an opposite insertion end and extend within said stack in a direction with the top end toward said top of said stack and the insertion end toward said base of said stack, said first elongate metal members being of a length of substantially twice the thickness of such first hard wood boards to extend through at least one of said first hard wood boards and at least substantially through a second one of said first hard wood boards.

* * * * *